US008840964B2

(12) United States Patent
Fuchs et al.

(10) Patent No.: US 8,840,964 B2
(45) Date of Patent: Sep. 23, 2014

(54) COMPOSITION FOR OIL- AND/OR WATER-REPELLENT FINISHING OF FIBER MATERIALS

(75) Inventors: Andreas Fuchs, München (DE); Isabella Rettenbacher, Gersthofen (DE); Rolf Moors, Bonstetten (DE); Walter Nassl, Affing (DE); Jürgen Arnold, Dasing-Wessiszell (DE)

(73) Assignee: Huntsman Textile Effects (Germany) GmbH (DE)

( * ) Notice: Subject to any disclaimer, the term of this patent is extended or adjusted under 35 U.S.C. 154(b) by 338 days.

(21) Appl. No.: 13/394,354

(22) PCT Filed: Sep. 22, 2010

(86) PCT No.: PCT/EP2010/005812

§ 371 (c)(1), (2), (4) Date: Mar. 6, 2012

(87) PCT Pub. No.: WO2011/035906

PCT Pub. Date: Mar. 31, 2011

(65) Prior Publication Data

US 2012/0177832 A1 Jul. 12, 2012

(30) Foreign Application Priority Data

Sep. 26, 2009 (EP) ..... 09012250

(51) Int. Cl.

| | |
|---|---|
| ***D06M 15/70*** | (2006.01) |
| ***D06M 15/643*** | (2006.01) |
| ***D06M 15/564*** | (2006.01) |
| ***D06M 13/02*** | (2006.01) |
| ***D06M 13/188*** | (2006.01) |
| ***D06M 15/227*** | (2006.01) |
| ***D06M 15/427*** | (2006.01) |
| ***D06M 15/277*** | (2006.01) |

(52) U.S. Cl.

CPC ..... *D06M 13/02* (2013.01); *D06M 2200/11* (2013.01); *D06M 15/643* (2013.01); *D06M 2200/12* (2013.01); *D06M 13/188* (2013.01); *D06M 15/227* (2013.01); *D06M 15/427* (2013.01); *D06M 15/564* (2013.01); *D06M 15/277* (2013.01)

USPC ..... 427/387; 427/393.4; 427/392; 252/8.62

(58) Field of Classification Search

CPC .. D06M 15/70; D06M 15/643; D06M 15/564

USPC ..... 427/387, 393.4, 392; 252/8.62

See application file for complete search history.

(56) References Cited

U.S. PATENT DOCUMENTS

| | | | | |
|---|---|---|---|---|
| 5,508,370 | A | 4/1996 | Reiff et al. | |
| 6,080,830 | A * | 6/2000 | Dirschl et al. | 528/45 |

FOREIGN PATENT DOCUMENTS

| | | |
|---|---|---|
| EP | 0234724 | 9/1987 |
| EP | 0314944 | 5/1989 |
| EP | 0537578 | 4/1993 |
| EP | 0872503 | 10/1998 |
| EP | 1225269 | 7/2002 |
| EP | 1493761 | 1/2005 |
| EP | 1632542 | 3/2006 |
| FR | 2213333 | 8/1974 |
| WO | 03/014180 | 2/2003 |
| WO | 2008/022985 | 2/2008 |
| WO | 2009/000370 | 12/2008 |

OTHER PUBLICATIONS

Honda, Koji, et al., "Molecular Aggregation Structure and Surface Properties of Poly(fluoroalkyl acrylate) Thin Films", Macromolecules 2005, vol. 38, pp. 5699-5705, Apr. 30, 2005.

* cited by examiner

*Primary Examiner* — Kelechi Egwim

(57) ABSTRACT

Described are 8 aqueous compositions useful for treating textile materials to impart oil- and/or water-repellent properties thereto. The compositions contain inter alia polymers containing perfluoroalkyl groups ($R_F$ groups), wherein 55 to 100% of the $R_F$ groups contain 6 carbon atoms.

11 Claims, No Drawings

COMPOSITION FOR OIL- AND/OR WATER-REPELLENT FINISHING OF FIBER MATERIALS

CROSS REFERENCE TO RELATED APPLICATIONS

This application is the National Phase of International Application PCT/EP2010/005812 filed Sep. 22, 2010 which designated the U.S. and which claims priority to European (EP) Pat. App. No. 09012250.8 filed Sep. 26, 2009. The noted applications are incorporated herein by reference.

This invention relates to an aqueous composition which is very useful for treating textile fabrics composed of fiber materials such as, for example, wovens, knitted fabrics or fibrous nonwoven webs (nonwovens). It further relates to a process for treating the fabrics.

It is known to treat textile fabrics composed of fiber materials with polymers containing perfluoroalkyl groups ($R_F$ groups) of the structure $CF_3—(CF_2)_x—CF_2—$. These $R_F$ groups are at their generally customary chain length when x in the recited formula is 6 or more, i.e., when the $R_F$ group contains 8 or more carbon atoms. Such polymers can be used to confer oil- and/or water-repellent properties on fiber materials. In prior art compositions, the polymers containing $R_F$ groups are frequently embodied as poly(meth)acrylates which contain the following structural unit:

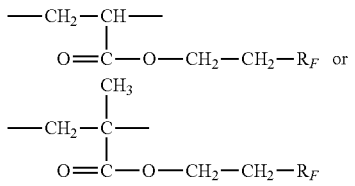

Such polymers are particularly useful as ingredients of formulations for the oil/water-repellent finishing of textile materials.

The use of polyacrylates containing $R_F$ groups for treating textiles is apparent from EP 314 944 A2. Similarly, WO 03/14180 A1 describes the treatment of fiber materials with polymers containing $R_F$ groups.

The treatment of textile materials with polymers containing $R_F$ groups is also known from EP 1 632 542 A1.

Ecologically, it would be desirable to use shorter chain lengths for the $R_F$ groups, i.e., fewer than 8 carbon atoms in the $R_F$ chain. However, tests have shown that a shorter chain length leads to poorer oil/water repellency values (see "Macromolecules 2005, 38, 5699-5705" Takahara et al.).

EP 1493 761 A1 describes compositions in which the chain length of the $R_F$ group of the polymers amounts to 3 or 4 carbon atoms. According to this reference, oil and water repellency values are obtainable in textile finishing at approximately the same level as that obtained when using fluoropolymers having an $R_F$ group chain length of 8 carbon atoms. Yet, despite an ecological advantage, the oil- and water-repellent effect obtained with the compositions of this EP is not fully satisfactory.

The compositions of WO 2008/022985 A1 likewise describe polymers containing perfluoroalkyl groups in which the $R_F$ groups contain fewer than 8 carbon atoms. Specific polymers are concerned here, the preparation of which utilizes a thermally crosslinkable or reactive isocyanate as a monomeric building block. Similarly, the compositions of this reference fail to provide optimal oil- and/or water-repellent properties on finished textiles.

It is an object of the present invention to provide a composition that provides ecological and cost advantages over known compositions, in which the $R_F$ groups of the polymers containing perfluoroalkyl groups contain 8 or more carbon atoms, and that provides at least the effect level of these known compositions as far as the oil- and water-repellent properties of finished textile materials are concerned.

We have found that this object is achieved by an aqueous composition containing at least the components A, B and C, wherein component A is either a mixture containing at least the components A1 to A3, wherein component A1 is a paraffin wax, component A2 is a condensation product of an alcohol having 12 to 22 carbon atoms, an etherified, preferably quaternized polymethylol melamine and optionally in addition a polyfunctional ethanolamine, which condensation product may contain 0.05% to 1.5% by weight of an acid, preferably acetic acid, component A3 is water, or wherein component A is a mixture containing at least the components A4 to A6, wherein component A4 is a polysiloxane which, in addition to alkyl groups attached to silicon atoms, additionally contains hydrogen atoms attached to silicon atoms, i.e., an alkyl-hydrogen-polysiloxane, component A5 is water and component A6 is a dispersant, preferably an ethoxylated alcohol or a mixture of ethoxylated alcohols, wherein preferably ethoxylated linear or branched alcohols having 8 to 20 carbon atoms are used, wherein component B is a mixture containing at least the components B1 to B3, wherein component B1 is a polyurethane which contains isocyanate groups and whose isocyanate groups are blocked, preferably with an aliphatic ketoxime, wherein the polyurethane is preferably constructed from an aromatic or aliphatic, preferably an aromatic, diisocyanate, wherein the diisocyanate preferably was reacted with a diol having 2 to 6 carbon atoms, a trivlanet aliphatic alcohol and an N-alkylated diethanolamine or triethanolamine, wherein component B2 is a dispersant or dispersant mixture and contains ethoxylated alcohols and optionally a dihydric aliphatic alcohol and optionally an inorganic acid, wherein component B3 is water, wherein component C is a polymer containing perfluoroalkyl groups ($R_F$ groups), wherein 55 to 100% of all $R_F$ groups present contain 6 carbon atoms, wherein the composition optionally further contains, as component D, a zirconium salt, preferably zirconium acetate.

Normally the oil- and water-repellent effects conferred by fiber treatment formulations are observed to deteriorate on shortening the chain length of the $R_F$ groups. This undesirable deterioration can be compensated to some extent by admixing the compositions of polymers containing $R_F$ groups with further products known as extenders. In this way, the compositions of EP 1 493 761 A1 attain approximately the effect level which eventuates for chain lengths of 8 carbon atoms in the $R_F$ group, even though the chain length in the compositions of this EP is only equal to 3 or 4 carbon atoms. On the other hand, a shorter chain length offers ecological advantages over $C_8$.

The findings mentioned appear to suggest that the composition of the present invention would produce, on finished textiles, oil- and water-repellent effects at approximately the same level as results using chain lengths of 3 or 4 carbon atoms on the one hand and 8 carbon atoms on the other. Surprisingly, this is not the case. This is because it was found—quite unexpectedly to a person skilled in the art—that compositions according to the present invention provide appreciably improved oil—and/or water-repellent properties on finished textile materials compared with the use of polymers containing $R_F$ groups wherein the average number of carbon atoms in the $R_F$ groups is 3-4, or 8. This holds for the same fiber add-on, and so lower product add-ons on the textile are used with compositions according to the present invention than in the case of known formulations in order that the same effect level may be achieved. It will be appreciated that this results in a cost advantage.

A decisive point with the compositions of the present invention is the length of the chain of the $R_F$ groups. The maximum of the chain length distribution shall be located at 6 carbon atoms, i.e., 55 to 100%, preferably 70 to 100%, of the number of all $R_F$ groups present must have 6 carbon atoms. Particularly good results are obtained when 100% of all $R_F$ groups present contain 6 carbon atoms. However, it is possible for some of the $R_F$ groups, namely from 0 to 45%, to have a chain length other than 6. However, the best results are obtained when about 100% of the $R_F$ groups contain 6 carbon atoms. It is accordingly preferable for 70 to 100% of the $R_F$ chains to contain 6 carbon atoms. The $R_F$ groups which do not contain 6 carbon atoms mostly have a chain length of 4 or 8 carbon atoms.

The polymers having perfluoroalkyl groups ($R_F$ groups), =component C of compositions according to the present invention, are preferably polyacrylic or polymethacrylic esters wherein the alcoholic component contains the $R_F$ group. The polymers in question preferably contain units of the formula

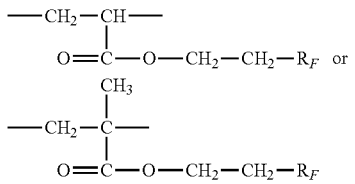

In addition, the polymers may contain still further units derived from copolymerizable monomers. Examples thereof are: vinyl chloride, vinylidene chloride, styrene, N-methylolacrylamide and fluorine-free comparatively long-chain (meth)acrylates such as stearyl acrylate and hydroxy derivatives thereof.

Polymers useful as component C are obtainable in a known manner by reacting (meth)acrylic acid or its esters with alcohols containing $R_F$ groups and then performing a free-radical polymerization, optionally in the presence of further polymerizable monomers. The alcohols containing $R_F$ groups mostly have 6 carbon atoms in the $R_F$ group, i.e., 55 to 100% of all $R_F$ groups contain 6 carbon atoms.

The $R_F$ groups preferably have the formula $$F_3C\text{-}(CF_2)_aCF_2\text{—}$$

where a is 4 in the majority of the $R_F$ radicals.

Structures of suitable (meth)acrylates and their preparation are described in WO 2009/000370 A1, EP 234 724 A1 and also FR 2 213 333 A. Polymers useful as component C for compositions according to the present invention are obtainable similarly to these references, except that attention must be paid to the chain length of the $R_F$ groups.

In addition to the preferred (meth)acrylates, component C may also utilize other polymers containing $R_F$ groups, for example polyurethanes having $R_F$ groups.

Component A in compositions according to the present invention is a mixture, either a mixture containing at the least the components A1 to A3, or a mixture containing at least the components A4 to A6.

Also suitable for use in the compositions of the present invention are mixtures which contain both the recited alternatives for component A, i.e., mixtures containing not only components A1 to A3 but also components A4 to A6, or which contain components A1 to A3, A4 and A6 (component A5 can be omitted because it corresponds to component A3).

Component A1 is a paraffin wax. Such waxes are commercially available and described by the CAS numbers 8002-74-2 and 64742-43-4. Preference is given to using waxes having a melting range of 50° C. to 80° C.

Component A2 is a condensation product which is obtainable by reacting an alcohol having 12 to 22 carbon atoms, preferably a linear monohydric alcohol, with a polymethylol melamine which is etherified and preferably quaternized, on the one hand and optionally in addition a polyfunctional ethanolamine, on the other. A hexamethylolmelamine etherified with methanol and quaternized with an alkyl sulfate is particularly useful. This condensation product is formed when the comparatively long-chain alcohol is reacted with the melamine and with the polyfunctional ethanolamine at the same time. Diethanolamine and triethanolamine are very suitable ethanolamines. Component A2 may additionally contain minor amounts of an acid, for example acetic acid, for example from 0.05 to 1.5% by weight.

Component A3 is water.

Component B in compositions according to the present invention is a mixture containing at least the components B1 to B3.

Component B1 is a polyurethane which contains blocked isocyanate groups, at least 90% of all isocyanate groups being blocked. Products known from the literature are useful as blocking agents. Aliphatic ketoximes, for example butanone oxime, are particularly advantageous for use as blocking agents. Preferred polyurethanes are preferably constructed from aliphatic, or, preferably, an aromatic diisocyanate preferably reacted with a trihydric aliphatic alcohol, for example 1, 1,1-trimethylolpropane, and an N-alkylated diethanolamine or triethanolamine. Polyurethanes useful as component B1 are commercially available, for example from Huntsman Textile Effects (Germany) GmbH.

Polyurethanes useful as component B1 and their preparation are described in EP 872 503 A1. Component B2 is a dispersant or a mixture of dispersants. Component B2 contains one or more ethoxylated alcohols based on comparatively long-chain, preferably linear, monohydric alcohols, and optionally in addition a dihydric aliphatic alcohol and optionally small amounts of an inorganic acid, for example hydrochloric acid. The chain length of the monohydric parent alcohol to the ethoxylated alcohol is preferably in the range from 8 to 22 carbon atoms. The optional dihydric alcohol preferably has 2 to 6 carbon atoms. Ethylene glycol and 1,2-propanediol are very useful.

Component B3 is water.

In an advantageous embodiment, compositions according to the present invention additionally contain, as component D, a zirconium salt, for which zirconium acetate is particularly useful. Compositions according to the present invention may contain still further products, for example montan wax acids (CAS No. 68476-03-9), particularly when zirconium acetate is present, or in addition to the paraffin already present in component A, still further paraffin. Another optional product is an ethoxylated fatty acid derivative (CAS No. 61791-12-6). In addition, further dispersants may be present, cationic surfactants in particular.

Owing to the presence of dispersants, compositions according to the present invention are normally aqueous dispersions. They are obtainable by known methods, for example by mixing the individual components at room temperature or, if necessary, at elevated temperature and subsequent mechanical homogenization.

However, it is preferable first to prepare a mixture which contains components A and B, but not component C. This mixture has good stability in storage. In this mode, component C is only added just prior to use of the composition of the present invention.

Preferably, compositions according to the present invention contain components A to D in the following amounts relative to each other:

35 to 120 parts by weight, preferably 45 to 90 parts by weight, more preferably 50 to 75 parts by weight, of component A 1 to 60 parts by weight, preferably 5 to 50 parts by weight, more preferably 8 to 20 parts by weight, of component B 1 to 60 parts by weight, preferably 1 to 45 parts by weight, more preferably 2 to 20 parts by weight, of component C 0 to 30 parts by weight, preferably 0 to 15 parts by weight, more preferably 1.5 to 8 parts by weight, of component D.

Preferred embodiments are further characterized in that component A does not contain components A4 to A6 and contains components A1 and A2 in the following amounts, A1: 10% to 30% by weight, preferably 12% to 25% by weight A2: 5% to 15% by weight, preferably 6% to 12% by weight, wherein the remainder of component A is formed by water (component A3) and optionally by small amounts of acetic acid, or in that component A does not contain components A1 to A3 and in that it contains components A4 to A6 in the following amounts:

A4: 25% to 45% by weight, preferably 30% to 40% by weight

A5: 50% to 70% by weight, preferably 55% to 65% by weight

A6: 1% to 5% by weight, preferably 3% to 5% by weight.

When compositions according to the present invention contain all components A1 to A6, the following amounts relative to each other are preferred:

A1: 8 to 30 parts by weight, preferably 10 to 20 parts by weight

A2: 3 to 20 parts by weight, preferably 4 to 12 parts by weight

A4: 1 to 15 parts by weight, preferably 2 to 10 parts by weight

A6: 0.05 to 3 parts by weight, preferably 0.1 to 2 parts by weight wherein the remainder of component A is formed by water (components A3 and A5).

Component B preferably contains components B1 and B2 in the following amounts:

B1: 8 to 40% by weight, preferably 12 to 30% by weight

B2: 2 to 20% by weight, preferably 3 to 15% by weight wherein the remainder of component B is formed by water (component B3).

The compositions of the present invention are very useful for treating textile fabrics composed of fiber materials in that excellent oil- and/or water-repellent properties are conferred on these as a result. The fabrics here are normally wovens, knitted fabrics or fibrous nonwoven webs (nonwovens). They can be used inter alia in the manufacture of the following end-use articles: rainwear and workwear. Preferably, the textiles consist of polyamide, polyester or polyester-cotton blends.

The treatment of the textile fabrics with compositions of the present invention can be effected by known methods, for example by means of a pad-mangle operation, in which case the fabrics to which the compositions have been applied are dried and normally cured at further increased temperature.

As already mentioned, it is advantageous when compositions according to the present invention are produced by first just the components A and B being mixed with each other and optionally mechanically homogenized and component C only being added just prior to the use of the composition for textile treatment. The treatment liquor is subsequently adjusted to the customary use concentration.

The examples which follow illustrate the invention.

EXAMPLE 1

Inventive

An aqueous liquor F1 containing 68 g/l of a component A, 32 g/l of a component B and 18.5 g/l of a component C(=OLEOPHOBOL® CP-S from Huntsman Textile Effects (Germany) GmbH) was prepared. Component C here is a polyacrylate having $R_F$ groups in the alcohol component, wherein about 100% of all $R_F$ groups contain 6 carbon atoms. Component A used contained one component A1, one component A2 and one component A3.

EXAMPLE 2

Noninventive, Comparative Example

Example 1 was repeated except that a different component C was used (OLEOPHOBOL® S) in an amount of 14.5 g/l. This component C likewise comprises a polyacrylate having $R_F$ groups. However, these $R_F$ groups mostly contain 8 carbon atoms.

The liquor thus obtained is hereinbelow referred to as F2.

EXAMPLE 3

Inventive

A liquor F3 containing 34 g/l of a component A, 26 g/l of a component B and 9.5 g/l of the same component C as in Example 1 was prepared. Component A used here contained one component A1, one component A2, one component A3, one component A4 and one component A6.

EXAMPLE 4

Noninventive, Comparative Example

Example 3 was repeated except that the same acrylate as in Example 2 was used as component C, in an amount of 7.5 g/l.

The liquor thus obtained is hereinbelow referred to as liquor F4.

Each of the liquors F1 to F4 additionally contained 1 g/l of 60% acetic acid.

Each one of the liquors F1 to F4 was applied to a woven fabric composed of 65% polyester/35% cotton by padding, followed by squeezing off to a wet pickup of about 60% by weight, drying at 110° C. and curing at 150° C. for 5 minutes.

The fabric samples thus obtained were subjected to the following tests:

a) oil repellency as per AATCC Test Method 118-2002
b) water droplet test as per AATCC Test Method 193-2005
c) spray test water repellency as per AATCC Test Method 22-2005

All the tests were carried out not only on the original fabric sample but also after 30 washes (60° C. with added laundry detergent) of the sample. The washes were carried out as per DIN EN ISO 6330, washing method 2A and tumble drying.

The results are shown in the table below:

| | Oil repellency | | Water droplet | | Spray | |
|---|---|---|---|---|---|---|
| | Original | after washing | Original | after washing | Original | after washing |
| Fabric treated with F1 | 5 | 4 | 8 | 7 | 100 | 80 |
| Fabric treated with F2 | 5 | 0 | 8 | 5 | 100 | 50 |
| Fabric treated with F3 | 5 | 4 | 8 | 8 | 100 | 80 |
| Fabric treated with F4 | 5 | 0 | 8 | 6 | 100 | 50 |

Higher numbers denote better oil or water repellency.

It is plainly evident that the fabrics treated with inventive liquors F1 and F3 have better properties than those treated with the liquors F2 and F4.

What is claimed is:

1. An aqueous composition containing at least the components A, B and C, wherein component A is a mixture containing at least the components A1 to A3, wherein component A1 is a paraffin wax, component A2 is a condensation product of an alcohol having 12 to 22 carbon atoms, an etherified polymethylol melamine and optionally a polyfunctional ethanolamine, which condensation product may additionally contain 0.05% to 1.5% by weight of an acid, and component A3 is water, component B is a mixture containing at least the components B1 to B3, wherein component B1 is a polyurethane which contains isocyanate groups and whose isocyanate groups are blocked and wherein the polyurethane is constructed from an aromatic or aliphatic diisocyanate, wherein the diisocyanate was reacted with a diol having 2 to 6 carbon atoms, a trihydric aliphatic alcohol and an N-alkylated diethanolamine or triethanolamine, component B2 is a dispersant or dispersant mixture and contains ethoxylated alcohols and optionally a dihydric aliphatic alcohol and optionally an inorganic acid, and component B3 is water, and component C is a polymer containing perfluoroalkyl groups ($R_F$ groups), wherein 55 to 100% of all $R_F$ groups present contain 6 carbon atoms, and wherein the composition optionally further contains, as component D, a zirconium salt.

2. The composition according to claim 1, characterized in that the polymer containing $R_F$ groups (component C) is a polyacrylic or polymethacrylic ester containing $R_F$ groups in the alcohol component.

3. The composition according to claim 1 characterized in that it contains not only components A1 to A3 but also components A4 to A6.

4. The composition according to claim 1, characterized in that it contains components A to D in the following amounts:

35 to 120 parts by weight of component A 1 to 60 parts by weight of component B 1 to 60 parts by weight of component C 0 to 30 parts by weight of component D wherein the parts by weight are based on the total parts by weight of the composition.

5. The composition according to claim 4, characterized in that it contains components A1 and A2 in the following amounts, A1: 10% to 30% by weight,
A2: 5% to 15% by weight,
wherein the remainder of component A is formed by water (component A3) and optionally acetic acid.

6. The composition according to claim 4, characterized in that component A does not contain components A1 to A3 and in that it contains components A4 to A6 in the following amounts:

A4: 25% to 45% by weight,
A5: 50% to 70% by weight,
A6: 1% to 5% by weight.

7. The composition according to claim 3, characterized in that component A contains components A1 to A6 in the following amounts:

A1: 8 to 30 parts by weight,
A2: 3 to 20 parts by weight,
A4: 1 to 15 parts by weight,
A6: 0.05 to 3 parts by weight,
wherein the remainder of component A is formed by water (components A3 and A5) and
wherein the parts by weight are based on the total parts by weight of the composition.

8. The composition according to claim 4, characterized in that component B contains components B1 and B2 in the following amounts:

B1: 8% to 40% by weight,
B2: 2% to 20% by weight,
wherein the remainder of component B is formed by water (component B3).

9. A process for treating textile fabrics composed of fiber materials comprising treating the fabrics with a composition according to claim I and subsequently drying the fabrics.

10. The process according to claim 9, characterized in that the fiber materials consist of polyamide, polyester or a polyester/cotton blend.

11. The process according to claim 9, characterized in that component C is only mixed with components A and B just prior to the treatment of the fiber materials.

* * * * *